US006537141B1

(12) United States Patent
Liu et al.

(10) Patent No.: US 6,537,141 B1
(45) Date of Patent: Mar. 25, 2003

(54) NON-SLIP POLISHER HEAD BACKING FILM

(75) Inventors: Albert H. Liu, San Antonio; Nelson W. White, II, Blanco, both of TX (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/774,845

(22) Filed: Jan. 30, 2001

(51) Int. Cl.[7] ..... B24B 1/00

(52) U.S. Cl. ..... 451/285; 451/288; 451/41; 451/398

(58) Field of Search ..... 451/285–289, 451/398, 388, 390, 397, 41, 364, 379, 384; 216/88, 89; 438/692, 693

(56) References Cited

U.S. PATENT DOCUMENTS 5,618,354 A * 4/1997 Lofaro ..... 134/25.4
5,762,539 A * 6/1998 Nakashiba et al. ..... 451/41
5,876,269 A * 3/1999 Torii ..... 451/41
5,885,135 A * 3/1999 Desorcie et al. ..... 451/41
6,083,990 A * 7/2000 Bamba ..... 451/288
6,139,409 A * 10/2000 Inaba ..... 451/288
6,171,513 B1 * 1/2001 Davis et al. ..... 216/88
6,276,999 B1 * 8/2001 Watanabe et al. ..... 451/41
6,309,290 B1 * 10/2001 Wang et al. ..... 451/398

* cited by examiner

*Primary Examiner*—George Nguyen
(74) *Attorney, Agent, or Firm*—Peter Zawilski

(57) ABSTRACT

A polisher head backing film that resists slipping relative to a backing plate. In one embodiment, a polisher head backing film/backing plate assembly is provided. The backing film/backing plate assembly includes a backing film with a hole pattern as well as holding pins that protrudes from one of the film's surfaces. The backing film/backing plate assembly also includes a backing plate that has a corresponding hole pattern and receiving holes such that the hole patterns on the backing film and backing plate can be aligned. The receiving holes can receive the holding pins of the backing film such that when the hole patterns are aligned, the holding pins and the receiving holes are also aligned. The holding pins can thus be inserted into the receiving holes upon alignment such that the backing film is prevented from moving relative to the backing plate once the holding pins are properly inserted.

21 Claims, 4 Drawing Sheets

NON-SLIP POLISHER HEAD BACKING FILM

FIELD OF THE INVENTION

The field of the present invention pertains to semiconductor fabrication processing. More particularly, the present invention relates to a method and device for more effectively mounting a backing film onto a polisher head in a chemical mechanical polishing machine.

BACKGROUND OF THE INVENTION

Much of the power and usefulness of today's digital integrated circuit (IC) devices can be attributed to the increasing levels of integration. More and more components, such as resistors, diodes, transistors and the like, are continually being integrated into the underlying chip, or IC. The starting material for typical ICs is very high purity silicon. The material is grown as a single crystal and takes the shape of a solid cylinder. This crystal is then sawed, similar to slicing a loaf of bread, to produce wafers typically 10 to 30 cm in diameter and 250 microns thick.

The geometry of the features of the IC components are commonly defined photographically through a process known as photolithography. Very fine surface geometries can be reproduced accurately by this technique. The photolithography process is used to define component regions and build up components one layer on top of another. Complex ICs can often have many different built up layers, with each layer having its own components, differing interconnections, and stacked on top of the previous layer. The resulting topography of these complex ICs often resemble familiar terrestrial "mountain ranges," with many "hills" and "valleys" as the IC components are built up on the underlying surface of the silicon wafer.

In the photolithography process, a mask image, or pattern defining the various components is focused onto a photosensitive layer using ultraviolet light. The image is focused onto the surface using the optical means of the photolithography tool, and is imprinted into the photosensitive layer. To build ever smaller features, increasingly fine images must be focused onto the surface of the photosensitive layer or, stated differently, optical resolution must increase. As optical resolution increases, the depth of focus of the mask image correspondingly narrows. This is due to the narrow range in depth of focus imposed by the high numerical aperture lenses in the photolithography tool. This narrowing depth of focus is often the limiting factor in the degree of resolution obtainable, and thus, the smallest components obtainable using the photolithography tool. The extreme topography of complex ICs, defined by the "hills" and "valleys" as described above, exaggerate the effects of decreasing depth of focus. Thus, in order to properly focus the mask image defining sub-micron geometries onto the photosensitive layer, a precisely flat surface is desired. The precisely flat (e.g., planarized) surface will allow for extremely small depths of focus and, in turn, will allow the definition and subsequent fabrication of extremely small components.

Chemical-mechanical polishing (CMP) has been widely used in semiconductor fabrication and processing to planarize a silicon wafer and/or to removal blanket material thereon. Typically, CMP involves removing a sacrificial layer of dielectric material using mechanical contact between the wafer and a moving polishing pad that is saturated with a chemical known as polishing slurry. Polishing minimizes the height differences between high and low spots on the wafer, since higher spots ("hills") are removed faster than lower spots ("valleys") during the polishing process. Polishing in this manner is the only technique that produces a smooth topography on a processed wafer when it is examined on a millimeter scale. That is, the wafer is essentially flat (e.g., planarized) when measured over the distance of a millimeter, and angles between high and low spots remaining after CMP are generally much less than one degree.

Regardless of its exact design, a typical CMP machine has a polisher head and carrier mechanism that holds the wafer during the polishing process. Inside the polisher head, there is usually a backing film between the wafer and the backing plate of the carrier. On the backing plate, there is a hole pattern that comprises numerous air holes and allows the user to adjust the magnitude and direction of back pressure that is applied to the wafer. The backing film has a hole pattern corresponding to that on the backing plate of the carrier. The perforated backing film is attached to the backing plate so that their respective hole patterns align. As such, proper pressure as specified by the user can be applied by the polisher head to the wafer through both the backing plate and the backing film.

Traditionally, in order to prevent the backing film from rotating relative to the carrier during polishing operations, which would result in misalignment of the perforations on the backing film with the air holes of the backing plate, an adhesive is applied to the contact surface(s) of the backing film and/or the backing plate to hold the backing film in place. However, this method is problematic because over time the adhesive on the backing film/backing plate interface wears out. As a result, the backing film begins to slip in the opposite direction of the rotating carrier. The tendency of slipping is especially strong during those processes that require much mechanical action. Eventually, the perforations of the backing film are no longer aligned with the air holes of the backing plate, thereby partially or even completely blocking off the air flow that is applied by the polisher head to the wafer. Consequently, the desired pressure cannot be correctly applied to the wafer.

Another problem with the use of adhesive relates to certain high temperature polishing processes. During such processes, in which the operating temperature can well exceed 100° F., the performance of the backing film could be degraded due to the presence of the adhesive. Moreover, a strong adhesive is usually used to affix the backing film in order to prevent slipping. Yet, the use of strong adhesives creates yet another problem during carrier rebuilds, as the adhesives can be very difficult to clean off. In addition, the use of thicker adhesives could possibly clog the holes on the backing film and/or the backing plate, thus again negatively affecting the performance of the carrier to apply the correct back pressure on the back side of the wafer.

In sum, these shortcomings of the prior art solutions adversely affect the performance of the CMP machine. More particularly, they degrade the expected lifetime of the backing film and/or the carrier. At the least, once the slipping as described above has started, the user would have to readjust or replace the misaligned backing film in order to properly control the pressure that is applied to the wafer being processed in the CMP machine.

Thus, what is needed is a mechanism which reliably prevents the backing film in the polisher head of a CMP machine from slipping during polishing operations. Further, what is needed is a mechanism which achieves the above without the drawbacks described above, namely, the short useful life expectancy of the backing film and/or the carrier, the difficulty of performing carrier rebuilds, the clogging of air holes and/or backing film perforations, and the performance degradation due to high temperatures. The present invention provides a solution that meets the recited needs.

SUMMARY OF THE INVENTION

It would be advantageous to provide a mechanism which reliably prevents the backing film in the polisher head of a CMP machine from slipping during polishing operations. More particularly, it would be desirable to provide a mechanism which achieves the above without imposing a short useful life expectancy of the backing film and/or the carrier, or rendering carrier rebuilds difficult to perform. It would also be beneficial to provide a solution that does not cause air holes and/or backing film perforations to be clogged, or suffer from performance degradation during high temperature processes.

Accordingly, the present invention provides a non-slip polisher head backing film for use in a CMP machine. More particularly, the present invention reliably prevents slipping of the backing film from occurring for a prolonged period, so that the backing film and the carrier have an extended useful life. The present invention is also immune from performance degradation during high temperature processes. Moreover, the present invention has no adverse effect on carrier rebuilds and does not cause clogging of air holes or backing film perforations.

More specifically, in one embodiment, the present invention polisher head backing film/backing plate assembly includes a backing film with a hole pattern as well as holding pins that protrudes from one of the film's surfaces. The backing film/backing plate assembly also includes a backing plate that has a corresponding hole pattern and receiving holes such that the hole patterns on the backing film and backing plate can be aligned. The receiving holes can receive the holding pins of the backing film and are positioned such that when the hole patterns are aligned, the holding pins and the receiving holes are aligned as well. Thus, upon proper alignment, the holding pins can be inserted into the receiving holes and the backing film cannot move relative to the backing plate once the holding pins are properly inserted. This embodiment of the present invention thus not only provides for the application of proper pressure by the polisher head to the wafer being polished, but also eliminates the problems associated with the use of adhesives as a means of backing film attachment as described above.

In one embodiment, the holding pins are located along the edge of the backing film, where they can best resist the tendency of the backing film to rotate or slip relative to the backing plate during polishing operations. In a currently preferred embodiment, the holding pins protrudes substantially vertically from the surface of the backing film.

In yet another embodiment, the present invention also provides a locking mechanism which can be engaged after the holding pins are inserted into the receiving holes in order to further ensure that the holding pins are locked in place and will not accidentally dislodge from the receiving holes.

BRIEF DESCRIPTION OF THE DRAWINGS

The present invention is illustrated by way of example, not by way of limitation, in the figures of the accompanying drawings, in which like reference numerals refer similar elements and in which.

DETAILED DESCRIPTION OF THE INVENTION

Reference will now be made in detail to the preferred embodiments of the invention, a non-slip polisher head backing film, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be clear to one of ordinary skill in the art that the present invention may be practiced without these specific details. In other instances, well known methods, procedures, components, and circuits have not been described in detail as not to unnecessarily obscure aspects of the present invention.

The present invention provides a non-slip polisher head backing film for use in a CMP machine. More particularly, the non-slip polisher head backing film of the present invention remains securely attached to the backing plate of the carrier during polishing operations, so that the hole patterns of the backing plate and of the backing film stay aligned. Importantly, slipping of the backing film is completely avoided even over prolonged periods, and the backing film and the carrier have an extended useful life. Moreover, the present invention is immune from performance degradation during high temperature processes, has no adverse effect on carrier rebuilds and does not cause clogging of air holes or backing film perforations because the use of adhesive is not required as in the prior art. Details regarding these and other aspects of the present invention are discussed below. Specifically, the following description of the present invention will begin with a description of the structure and nomenclature of a CMP machine on which embodiments of the present invention may be practiced. This description will then be followed by a detailed description setting forth the operation of the present invention.

An Exemplary CMP Machine for Practicing Embodiment of the Present Invention

Figure 1A:
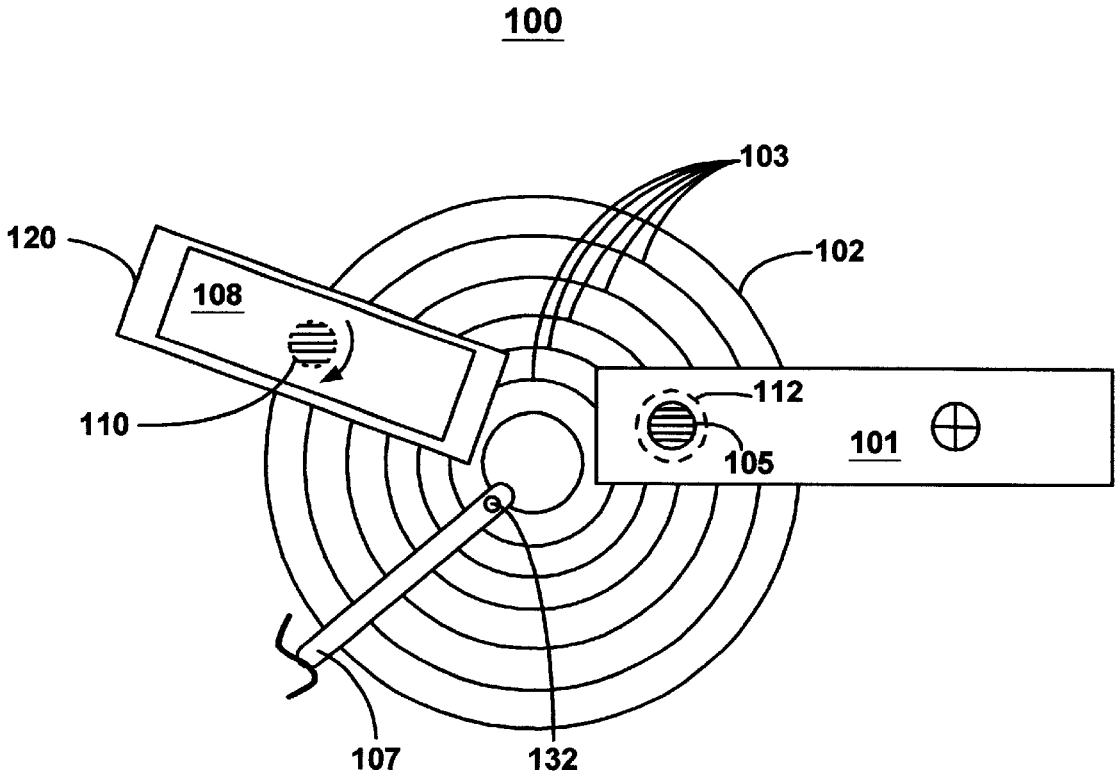
FIG. 1A shows a down view of a CMP machine on which embodiments of the present invention can be practiced.
Figure 1B:
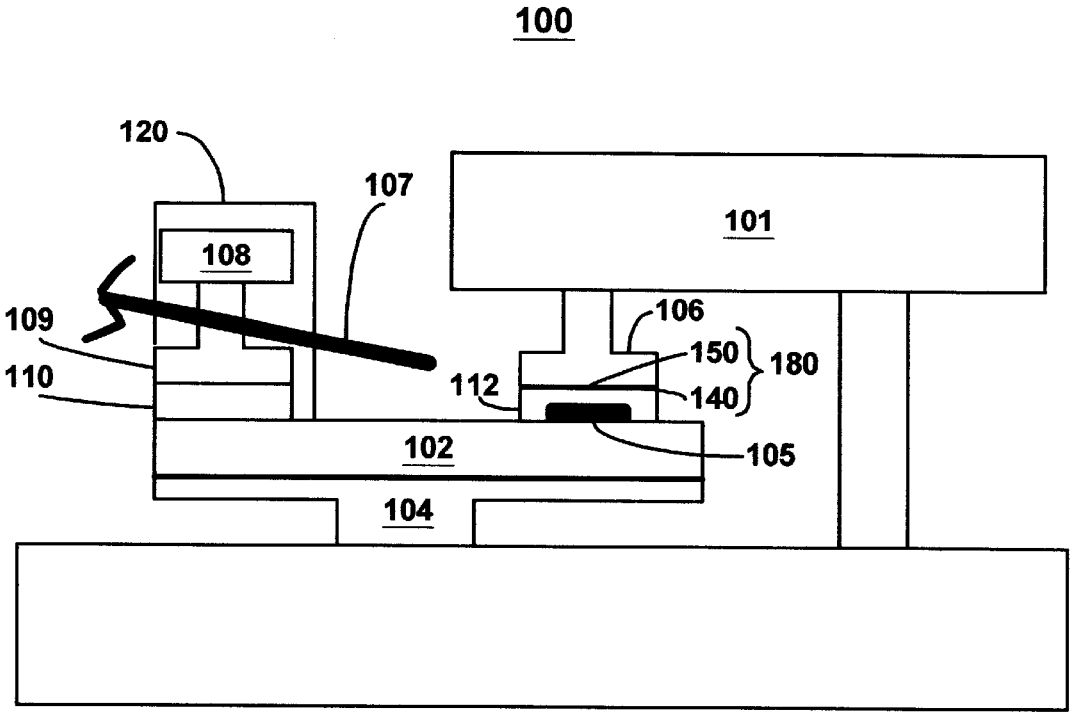
FIG. 1B shows a side cut away view of the CMP machine shown in FIG. 1A.

FIG. 1A shows a plan view of a CMP machine 100, while FIG. 1B shows a side cut away view of CMP machine 100 of FIG. 1A. Wafers to be polished are fed to CMP machine 100, which picks up the wafers with a polisher head 101 and places them onto a rotating polishing pad 102. Polishing pad 102 is made of a resilient material and is textured, often with a plurality of predetermined groves 103, to aid the polishing process. Polishing pad 102 rotates at a predetermined speed on a platen, or turntable, 104 located beneath polishing pad 102. A wafer 105 is held in place on polishing pad 102 by a carrier ring 112 and a carrier 106, which is attached to polisher head 101. Specifically, one surface of wafer 105 rests against polishing pad 102, while the other surface of wafer 105 is held against the lower surface of carrier 106 of polisher head 101. As polishing pad 102 rotates, polisher head 101 rotates wafer 105 at a predetermined rate and also forces wafer 105 onto polishing pad 102 with a predetermined amount of downward force.

Referring still to FIGS. 1A and 1B, carrier 106 of polisher head 101 includes a backing plate 150. In addition, a backing film 140 is attached to backing plate 150 such that it is between wafer 105 and backing plate 150 of carrier 106. A hole pattern that comprises numerous air holes (not shown) is present on backing plate 150, enabling the user to adjust the magnitude and direction of back pressure that is applied to wafer 105. Backing film 140 has a corresponding hole pattern (not shown) as that on backing plate 150 of carrier 106. Perforated backing film 140 is attached to backing plate 150 so that their respective hole patterns align. As such, proper pressure as specified by the user can be applied by polisher head 101 to wafer 105 through both backing plate 150 and backing film 140.

CMP machine 100 also includes a slurry dispense arm 107 extending across the radius of polishing pad 102. Slurry dispense arm 107 dispenses a flow of slurry onto polishing pad 102 via port 132. Usually, slurry is dispensed as slurry dispense arm 107 traverses across the radius of polishing pad 102 and as polishing pad 102 rotates, so that the slurry is uniformly dispersed across the surface of polishing pad 102. Nevertheless, only a small portion of the slurry dispensed by slurry dispense arm 107 ever comes into contact with wafer 105. The majority of the slurry eventually flows off of polishing pad 102 without being used.

The slurry is usually a mixture of de-ionized water and polishing agents designed to chemically aid the predictable planarization of wafer 105. More particularly, the CMP process typically uses an abrasive slurry on polishing pad 102. The polishing action of the slurry is comprised of an abrasive frictional component and a chemical component. The abrasive frictional component is due to the friction between the surface of polishing pad 102, the surface of wafer 105, and abrasive particles suspended in the slurry. The chemical component is due to the presence in the slurry of polishing agents which chemically interact with the material of the dielectric layer of wafer 105.

The rotating action of both polishing pad 102 and wafer 105, in conjunction with the chemical action of the slurry, combine to planarize, or polish, wafer 105 at some nominal rate referred to as the removal rate. A constant and predictable removal rate is important to the uniformity and performance of the wafer fabrication process. The removal should be expedient, yet yield precisely planarized wafers, free from surface topography. If the removal rate is too low, the number of planarized wafers produced in a given period of time would correspondingly be low, degrading wafer through-put of the fabrication process. If the removal rate is too high, the CMP planarization process will not be uniform across the surface of the wafers, degrading the yield of the fabrication process.

The constituents of the slurry are precisely determined and controlled in order to effect the most optimal CMP planarization. Differing slurries are used for differing layers of the semiconductor wafer, with each slurry having specific removal characteristics for each type of layer. Moreover, as slurry is "consumed" in the polishing process, the transport of fresh slurry to the surface of wafer 105 and the removal of polishing by-products away from the surface of wafer 105 becomes very important in maintaining the proper removal rate.

To aid in maintaining a stable and optimal removal rate, CMP machine 100 includes a conditioner assembly 120 for conditioning polishing pad 102. Conditioner assembly 120 includes a conditioner arm 108, which extends across the radius of polishing pad 102. An end effector 109 is connected to conditioner arm 108, and includes an abrasive conditioning disk 110 which is used to roughen the surface of polishing pad 102. Conditioning disk 110 is rotated by conditioner arm 108 in the same direction as polishing pad 102. As conditioning disk 110 is rotated, it is also translationally and repeatedly moved towards and away from the center of polishing pad 102, such that the movement of conditioning disk 110 follows the radius of polishing pad 102. In so doing, conditioning disk 110 covers nearly the entire surface area of polishing pad 102 as it rotates.

Conditioning polishing pad 102 helps to sustain an optimal removal rate because slurry transport is facilitated by the roughened texture of the surface of polishing pad 102. This texture is comprised of both predefined pits and grooves that are manufactured into the surface of polishing pad 102 as well as the inherently rough surface of the material from which polishing pad 102 is made. The roughened surface of polishing pad 102 is maintained throughout the polishing process by the action of conditioner assembly 120, which is typically coated with diamond. The roughened surface texture facilitates efficient removal of material from wafer 105, due to increased slurry transfer to the surface of wafer 105 as well as more effective application of polishing downward force. Without such conditioning, the surface of polishing pad 102 would be smoothened during the polishing process and the removal rate would decrease dramatically over time as a result. Conditioner assembly 120 serves to re-roughen the surface of polishing pad 102 and keep the grooves cleaned out, thereby improving the transport of slurry and sustaining an optimal removal rate.

Figure 2:
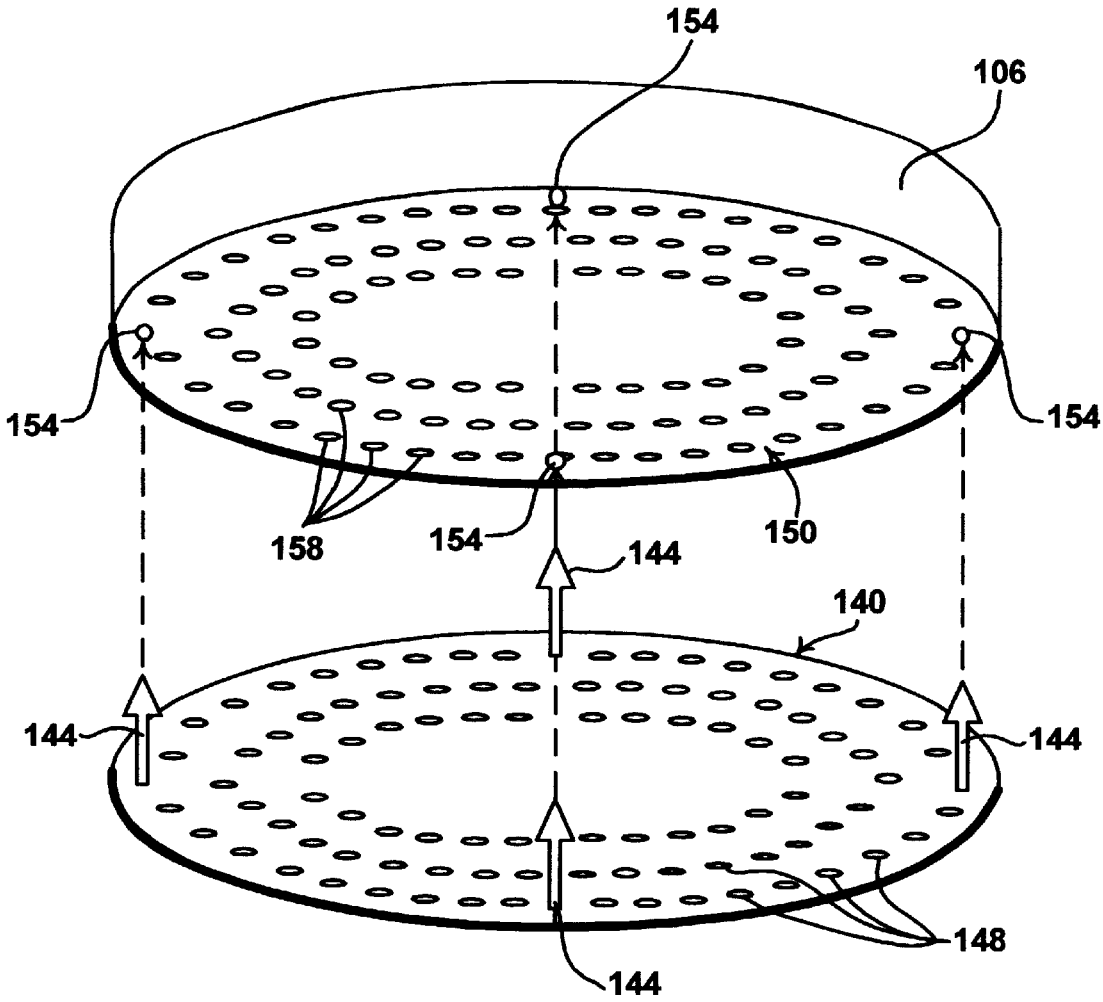
FIG. 2 illustrates a backing plate of a carrier as well as a perforated backing film prior to their attachment in accordance with one embodiment of the present invention.

Embodiments of Polisher Head Backing Film/ Backing Plate Assembly of the Present Invention Referring next to FIG. 2, backing plate 150 of carrier 106 as well as perforated backing film 140 in accordance with one embodiment of the resent invention are shown in greater detail. In FIG. 2, backing film 140 and backing plate 150 are shown as separate parts prior to attachment. On backing plate 150, numerous air holes 158, which collectively form a hole pattern, are present as shown. On the other hand, backing film 140 has a corresponding hole pattern, including holes 148 as illustrated, thereon. For ease of reference, backing film 140 and backing plate 150 can be referred to collectively as polisher head backing film/backing plate assembly 180.

In accordance with one embodiment of the present invention as illustrated in FIG. 2, perforated backing film 140 also has multiple holding pins or stubs 144 thereon, while backing plate 150 has multiple receiving holes 154 thereon. More specifically, each of receiving holes 154 matches up with one of stubs 144 such that stubs 144 can be plugged into receiving holes 154. Stubs 144 can be constructed in a variety of forms or shapes that facilitate the insertion of stubs 144 into receiving holes 154 and that enable stubs 144 to be secured in place after successful insertion. In a currently preferred embodiment shown in FIG. 2, stubs 144 are configured as push pins that protrude from one surface of backing film 140. In this embodiment, stubs 144 are oriented substantially orthogonal to the surface of backing film 140. It is appreciated that the placement of stubs 144 on backing film 140 and of receiving holes 154 on backing plate 150 is such that when the hole patterns on backing film 140 and backing plate 150 are aligned, stubs 144 and receiving holes 154 are also aligned. In a currently preferred embodiment, stubs 144 are made of the same material as backing film 140. Nevertheless, other compatible material (e.g., those having sufficient strength) can be used instead.

During carrier rebuild, backing film 140 is placed on the surface of backing plate 150. The hole patterns on backing film 140 and backing plate 150 are aligned, and stubs 144 are pushed through receiving holes 154 so that backing film 140 is securely attached to backing plate 150. Thereafter, an optional locking mechanism (not shown) is engaged to further ensure that stubs 144 are locked in place and will not accidentally dislodge from receiving holes 154. Thus, once they are fitted into receiving holes 154, stubs 144 serve to resist movement or other forms of displacement of backing film 140 with respect to backing plate 150 during polishing operations. In a currently preferred embodiment, stubs 144 are located along the edge of backing film 140 as illustrated in FIG. 2, where it can best resist the tendency of backing film 140 to rotate relative to backing plate 150 (e.g., slipping) during polishing operations. With proper alignment of the hole patterns being firmly secured by stubs 144, the desired pressure as specified by the user can be accurately applied by polisher head 101 to wafer 105.

Importantly, in a currently preferred embodiment as described above, the present invention eliminates the need of using adhesives to attach backing film 140 to backing plate 150. As such, the problems inherent in the use of adhesives that plague the prior art approaches are also advantageously avoided. In particular, unlike many adhesive-based approaches, embodiments of the present invention provide an extended useful life for the backing film/backing plate assembly and thus the carrier. Moreover, the present invention is immune from performance degradation during high temperature processes due to the presence of unstable adhesives. Furthermore, by using the present invention, carrier rebuilds no longer involve the difficult task of removing residual adhesive or cleaning out clogged air holes because the use of adhesive is not required in accordance with the present invention. Nevertheless, although the currently preferred embodiment of the present invention as described herein eliminates the usage of adhesives altogether, it is appreciated that the present invention does not preclude the use of adhesives to the backing film/backing plate assembly of the present invention. Indeed, if an adhesive that is not handicapped by the shortcomings described herein above (e.g., thermal breakdown, hard to clean off, etc.) can be identified, such an adhesive can beneficially be used with the backing film/backing plate assembly described above to further secure the attachment of backing film 140 to backing plate 150.

Additionally, modern CMP processes are migrating to the use of higher polishing pad rotation speeds. The increase polishing pad speeds make it even more important to have a mechanism that can effectively and reliably hold the backing film in place during polishing operations. The on-slip polisher head backing film of the present invention provides a highly desirable solution that is simple to implement. As such, the present invention is superior to existing approaches that rely heavily on the use of adhesives for backing film attachment.

Method for Preventing a Backing Film from Slipping in a Polisher Head

Figure 3:
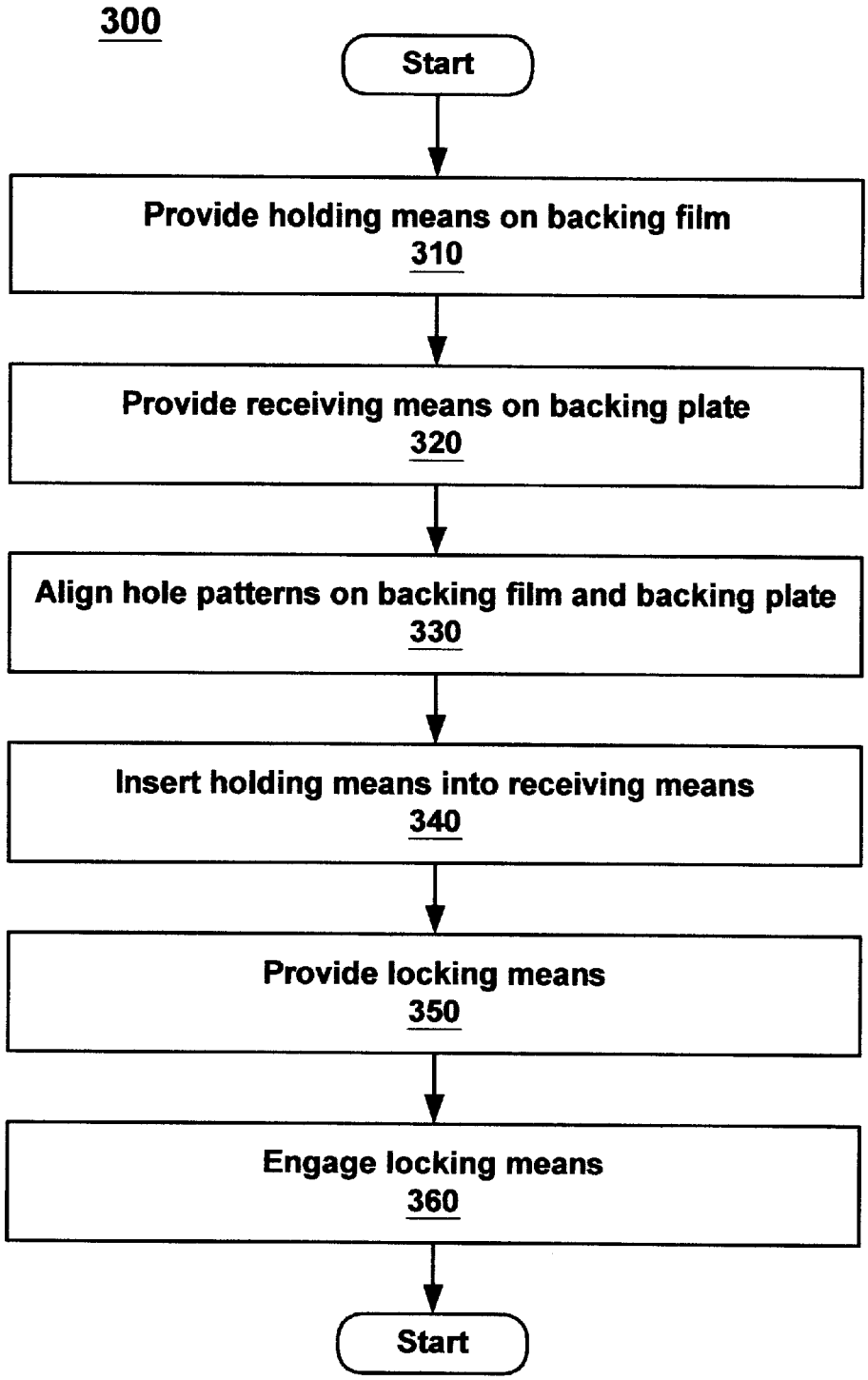
FIG. 3 is a flowchart of the steps in a process for preventing a backing film from slipping relative to the backing plate in a polisher head backing film/backing plate assembly of a CMP machine in accordance with one embodiment of the present invention.

Referring now to FIG. 3, a flowchart 300 of steps in a process for preventing a backing film from slipping relative to the backing plate in a polisher head backing film/backing plate assembly of a CMP machine in accordance with one embodiment of the present invention is shown. Process 300 depicts the operating process of a CMP machine (e.g., CMP machine 100 of FIGS. 1A and 1B) polishing a semiconductor wafer (e.g., wafer 105 of FIGS. 1A and 1B) using a polisher head backing film/backing plate assembly in accordance with one embodiment of the present invention.

With reference also to FIG. 2, process 300 of FIG. 3 begins with step 310, where holding means 144 is provided on backing film 140, which has a first hole pattern disposed thereon. In one embodiment, holding means 144 protrudes from a surface of backing film 140.

Referring again to FIGS. 2 and 3, in step 320, receiving means 154 is provided on backing plate 150, which has a second hole pattern disposed thereon. As described above, receiving means 154 is adapted to receive holding means 144, and the two hole patterns correspond to each other such that they can be aligned.

With reference still to FIGS. 2 and 3, in step 330, the first and second hole patterns are aligned such that holding means 144 and receiving means 154 are also aligned.

In step 340, holding means 144 is inserted into receiving means 154 upon alignment such that backing film 140 is prevented from moving relative to backing plate 150 subsequently.

In optional step 350, a locking means is provided which, when engaged, locks holding means 144 in place within receiving means 154.

In optional step 360, the locking means is engaged such that accidental dislodgment of holding means 144 from receiving means 154 is prevented.

Thus, unlike many adhesive-based approaches, embodiments of the present invention provide an extended useful life for the backing film/backing plate assembly and thus the carrier. Moreover, embodiments of the present invention do not suffer from performance degradation during high temperature processes due to the presence of unstable adhesives. Furthermore, by using embodiments of the present invention, carrier rebuilds no longer require performing the cumbersome tasks of removing residual adhesive and cleaning out clogged air holes, since the use of adhesive is not required in accordance with the present invention.

The foregoing descriptions of specific embodiments of the present invention have been presented for purposes of illustration and description. They are not intended to be exhaustive or to limit the invention to the precise forms disclosed, and clearly many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the Claims appended hereto and their equivalents.

What is claimed is:

1. A polisher head backing film/backing plate assembly for preventing slipping of a backing film relative to a backing plate, the polisher head backing film/backing plate assembly comprising:

a backing film having a first hole pattern disposed thereon and a holding means protruding from a surface of the backing film; and a backing plate having a second hole pattern and a receiving means disposed thereon, the second hole pattern corresponding to the first hole pattern on the backing film such that the first and second hole patterns can be aligned, the receiving means adapted to receive the holding means of the backing film such that when the first and second hole patterns are aligned, the holding means and the receiving means are also aligned, wherein the holding means can be inserted into the receiving means upon alignment such that the backing film is prevented from moving relative to the backing plate subsequent to the insertion of the holding means into the receiving means.

2. The polisher head backing film/backing plate assembly as recited in claim 1 wherein the holding means comprises a plurality of holding pins.

3. The polisher head backing film/backing plate assembly as recited in claim 1 wherein the holding means is disposed proximate to an edge of the surface of the backing film.

4. The polisher head backing film/backing plate assembly as recited in claim 1 wherein the holding means is oriented substantially orthogonal to the surface of the backing film.

5. The polisher head backing film/backing plate assembly as recited in claim 1 wherein the holding means is made from a material used in making the backing film.

6. The polisher head backing film/backing plate assembly as recited in claim 1 wherein no adhesive is used to attach the backing film to the backing plate.

7. The polisher head backing film/backing plate assembly as recited in claim 1 further comprising a locking means for preventing accidental dislodgment of the holding means from the receiving means.

8. A chemical mechanical polishing (CMP) machine used for polishing a semiconductor wafer such that a planar topography is created on a top surface of the semiconductor wafer to facilitate subsequent semiconductor processing steps performed on the semiconductor wafer, the CMP machine comprising:

a polishing pad mounted on the CMP machine, the polishing pad adapted to perform a polishing motion, wherein the CMP machine implements the polishing motion; and a polisher head backing film/backing plate assembly mounted on the CMP machine, wherein the polisher head backing film/backing plate assembly is adapted to place the semiconductor wafer onto the polishing pad and comprises a backing film having a first hole pattern disposed thereon and a holding means protruding from a surface of the backing film; and the polisher head backing film/backing plate assembly also comprises a backing plate having a second hole pattern and a receiving means disposed thereon, the second hole pattern corresponding to the first hole pattern on the backing film such that the first and second hole patterns can be aligned, the receiving means adapted to receive the holding means of the backing film such that when the first and second hole patterns are aligned, the holding means and the receiving means are also aligned, wherein the holding means can be inserted into the receiving means upon alignment such that the backing film is prevented from moving relative to the backing plate subsequent to the insertion of the holding means into the receiving means.

9. The CMP machine of claim 8 wherein the holding means of the polisher head backing film/backing plate assembly comprises a plurality of holding pins.

10. The CMP machine of claim 8 wherein the holding means of the polisher head backing film/backing plate assembly is disposed proximate to an edge of the surface of the backing film.

11. The CMP machine of claim 8 wherein the holding means of the polisher head backing film/backing plate assembly is oriented substantially orthogonal to the surface of the backing film.

12. The CMP machine of claim 8 wherein the holding means of the polisher head backing film/backing plate assembly is made from a material used in making the backing film.

13. The CMP machine of claim 8 wherein no adhesive is used to attach the backing film to the backing plate.

14. The CMP machine of claim 8 wherein the polisher head backing film/backing plate assembly further comprises a locking means for preventing accidental dislodgment of the holding means from the receiving means.

15. In a polisher head backing film/backing plate assembly of a chemical mechanical polishing (CMP) machine, a method for preventing a backing film from slipping relative to the backing plate, said method comprising the steps of:

providing a holding means on the backing film which has a first hole pattern disposed thereon, wherein the holding means protrudes from a surface of the backing film;

providing a receiving means on the backing plate which has a second hole pattern disposed thereon, wherein the receiving means is adapted to receive the holding means, and wherein the second hole pattern corresponds to the first hole pattern such that the first and second hole patterns can be aligned;

aligning the first and second hole patterns such that the holding means and the receiving means are also aligned; and inserting the holding means into the receiving means upon alignment such that the backing film is prevented from moving relative to the backing plate subsequent to the insertion of the holding means into the receiving means.

16. The method as recited in claim 15 wherein the holding means comprises a plurality of holding pins.

17. The method as recited in claim 15 wherein the holding means is disposed proximate to an edge of the surface of the backing film.

18. The method as recited in claim 15 wherein the holding means is oriented substantially orthogonal to the surface of the backing film.

19. The method as recited in claim 15 wherein the holding means is made from a material used in making the backing film.

20. The method as recited in claim 15 wherein no adhesive is used to attach the backing film to the backing plate.

21. The method as recited in claim 15 further comprising the steps of:

providing a locking means which when engaged locks the holding means in place within the receiving means; and engaging the locking means such that accidental dislodgment of the holding means from the receiving means is prevented.

* * * * *